US006332315B1

(12) United States Patent
Cappeller et al.

(10) Patent No.: US 6,332,315 B1
(45) Date of Patent: Dec. 25, 2001

(54) HYDRAULIC POWER SUPPLY UNIT, PARTICULARLY FOR AUXILIARY ACTUATORS IN PRESSES

(75) Inventors: Augusto Cappeller, Bassano Del Grappa; Vanni Gallocchio, Terme; Giampietro Pellanda, Cartigliano; Massimo Fiorese, Bassano Del Grappa, all of (IT)

(73) Assignee: Special Springs S.r.l., Rosa' (IT)

( * ) Notice: Subject to any disclaimer, the term of this patent is extended or adjusted under 35 U.S.C. 154(b) by 0 days.

(21) Appl. No.: 09/486,627

(22) PCT Filed: Aug. 28, 1998

(86) PCT No.: PCT/EP98/05517

§ 371 Date: Mar. 1, 2000

§ 102(e) Date: Mar. 1, 2000

(87) PCT Pub. No.: WO99/13227

PCT Pub. Date: Mar. 18, 1999

(30) Foreign Application Priority Data

Sep. 8, 1997 (IT) ..... 97A000194

(51) Int. Cl.[7] ..... F15B 1/02
(52) U.S. Cl. ..... 60/413
(58) Field of Search ..... 60/413, 415, 494, 60/470, 464, 468; 91/468

(56) References Cited

U.S. PATENT DOCUMENTS

| | | | | |
|---|---|---|---|---|
| 3,795,110 | * | 3/1974 | Kobelt | 60/413 |
| 4,173,866 | * | 11/1979 | Farr | 60/413 |
| 4,656,833 | * | 4/1987 | Belart | 60/413 X |
| 4,669,235 | * | 6/1987 | Gratzmuller | 60/416 |
| 4,716,812 | * | 1/1988 | Koerner et al. | 60/413 X |
| 4,741,247 | * | 5/1988 | Glomeau et al. | 60/413 X |
| 4,959,957 | * | 10/1990 | Schmale et al. | 60/413 |

FOREIGN PATENT DOCUMENTS

| | | |
|---|---|---|
| A-354 562 | 7/1961 | (CH) . |
| A-457 145 | 7/1968 | (CH) . |
| A-26 20 016 | 11/1977 | (DE) . |
| A-0 022 661 | 1/1981 | (EP) . |
| A-0 661 125 | 7/1995 | (EP) . |
| A-1 436 264 | 7/1966 | (FR) . |
| A-2 149 492 | 6/1985 | (GB) . |

* cited by examiner

*Primary Examiner*—John E. Ryznic
(74) *Attorney, Agent, or Firm*—Guido Modiano; Albert Josif; Daniel O'Byrne

(57) ABSTRACT

An actuation and supply unit, particularly for auxiliary actuators suitable to actuate complementary fixtures and/or tools in die-forming presses actuated by a main actuator, comprising a hydraulic power source which is associated with a reservoir and is connected to a section for accumulating the hydraulic power, the accumulation section being associated, through the interposition of distribution cylinder, with at least one auxiliary actuator.

16 Claims, 2 Drawing Sheets

HYDRAULIC POWER SUPPLY UNIT, PARTICULARLY FOR AUXILIARY ACTUATORS IN PRESSES

BACKGROUND OF THE INVENTION

The present invention relates to an actuation and supply unit, particularly for auxiliary actuators suitable to actuate complementary fixtures and/or tools in die-forming presses.

Die-forming presses associated with other complementary fixtures or tools which complete the machining process are currently widely used.

Merely by way of example, the presses can be associated with blanking machines for trimming the edge flash of the die and with punches or other blanking tools used to form one or more holes.

In particular, presses associated with other fixtures or tools are provided with a main actuator which actuates the press and with which other auxiliary actuators are associated. The auxiliary actuators are usually independent and are adapted to actuate the fixtures or tools related to the complementary machining processes.

In particular, auxiliary actuators are currently constituted, in a first type of construction, by a mechanical cam which is actuated, by means of kinematic systems, by the same actuation as the press.

This embodiment, however, entails considerable problems in terms of bulk and complexity of construction.

In a second embodiment, the press works like a pump for the auxiliary actuators, which in this case are constituted by hydraulic pistons.

However, manufacturing and production practice has shown that this solution entails, in high-tonnage presses, an imbalance of the die; moreover, it is evident that the complementary machining operations can be performed only during the return step of the pressing cycle, i.e., when the press is rising, but this is exactly the step in which the press absolutely cannot act as a pump, since it is in the discharge step.

Hydraulic plants, including actuations for auxiliary actuators and hydraulic power accumulators are known, for example, from the prior documents CH-A-354 562, EP-A-0 661 125, EP-A-022 661, DEA-26 20 016 FR-A-1 436 264.

SUMMARY OF THE INVENTION

The aim of the present invention is to provide an actuation and supply unit, particularly for auxiliary actuators suitable to actuate complementary fixtures and/or tools in die-forming presses, which solves the above-noted drawbacks of conventional solutions, particularly by making the actuation and supply of the auxiliary actuators substantially independent without causing drawbacks related to bulk and complexity in construction.

Accordingly, an object of the present invention is to provide a unit which avoids any imbalance of the die.

Another object of the present invention is to provide a unit which is particularly sturdy and flexible and can be applied to different presses.

Another object of the present invention is to provide a unit whose operation can optionally be made fully independent of the press.

Another object of the present invention is to provide a unit which is highly safe both for the machine and for operators.

Another object of the present invention is to provide a unit which can be manufactured with known technologies and at competitive costs.

This aim, these objects and others which will become apparent hereinafter are achieved by an actuation and supply unit, according to the invention, having the features set forth in claim 1.

Further advantageous features of preferred embodiments of the invention are defined in the dependent claims.

BRIEF DESCRIPTION OF THE DRAWINGS

Further characteristics and advantages of the present invention will become apparent from the following detailed description of two embodiments thereof, illustrated only by way of non-limitative example in the accompanying drawings, wherein.

DESCRIPTION OF THE PREFERRED EMBODIMENTS

Figure 1:
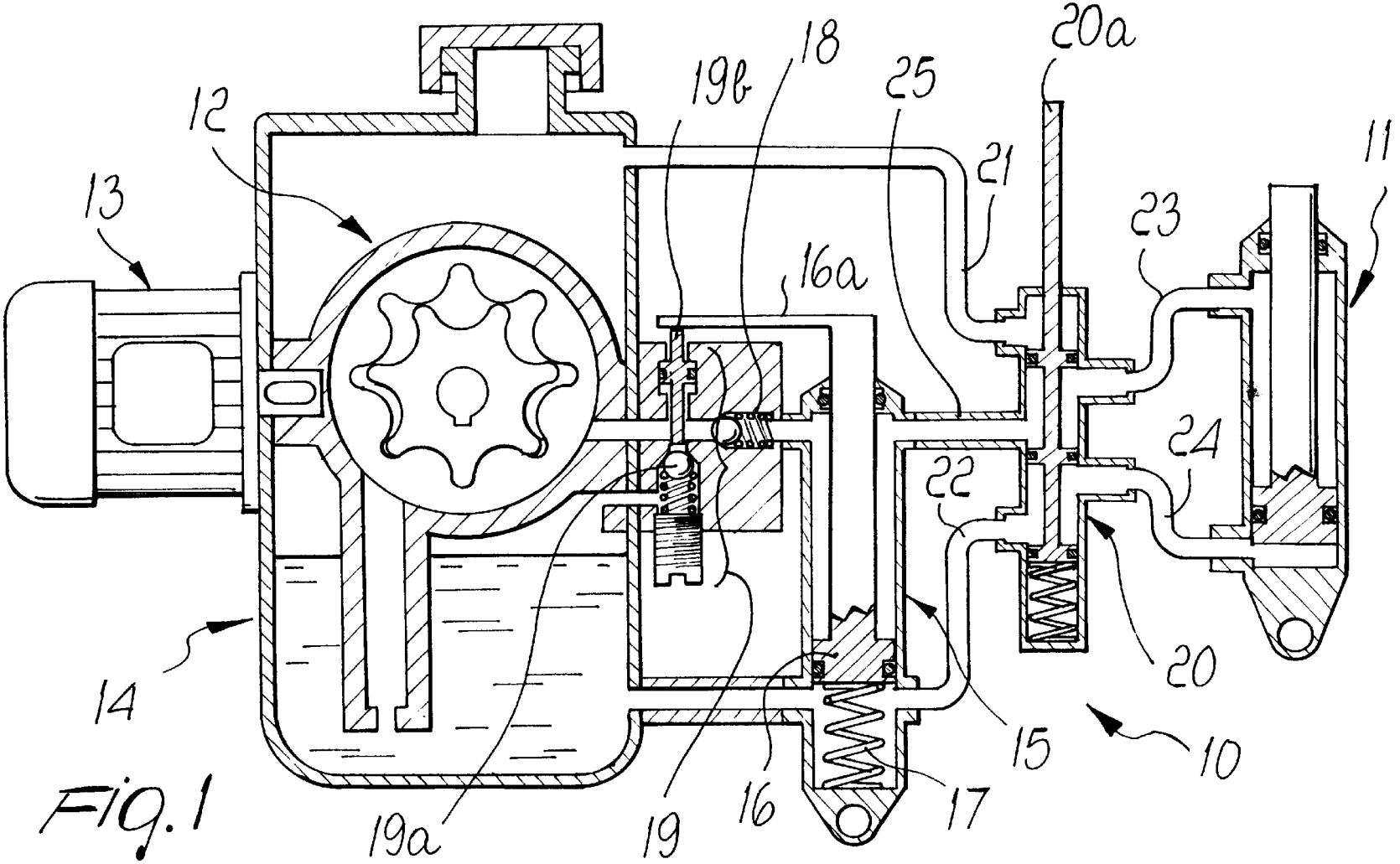
FIG. 1 is a schematic view of an actuation and supply unit according to the invention, in a first embodiment.

With particular reference to FIG. 1, an actuation and supply unit, particularly for auxiliary actuators suitable to actuate complementary fixtures and/or tools in die-forming presses actuated by a main actuator, according to the invention, is generally designated by the reference numeral 10.

The unit 10, in particular, in this case is suitable to actuate and supply an auxiliary hydraulic actuator 11 of the double-action type.

The unit 10 comprises a hydraulic power source which, in this first embodiment, is constituted by a positive-displacement gear pump 12 is which is associated with an electric motor 13 and is arranged within a reservoir 14 from which it draws a fluid (and is optionally provided with a level detection rod).

Said pump 12 can aspirate the fluid after it has passed through a heat exchanger, not shown in the figures, if cooling is required.

In other cases, the motor can be of another type, for example a mechanical motor.

In particular, the pump 12 is connected to a power accumulation section which, in this case, is constituted by a first cylinder 15 with a piston 16 which is associated with a resilient means which substantially comprises a helical spring 17 which is in turn associated with the auxiliary actuator 11 through the interposition of a distribution means described in greater detail hereinafter.

As an alternative, said power accumulation section can be constituted by an autoclave reservoir with an elastic membrane, and the resilient means can be constituted by a gas-tight reservoir with a movable wall or elastic membrane which acts in contrast with said piston 16.

In this case, the first cylinder 15 is connected to the pump 12 through the interposition of a check valve 18 and of a pressure limiting valve 19 (the piston 16, by means of the flap 16*a*, opens or closes recirculation to the reservoir 14 by moving the ball 19*a* by means of the rod 19*b*).

Said distribution means are constituted, in this case, by a slide valve 20 which is actuated from outside and is connected along two different lines 21 and 22 to the reservoir 14 and along two lines 23 and 24 to the auxiliary actuator 11 and is connected in input, along a line 25, to the first cylinder 15.

Figure 2:
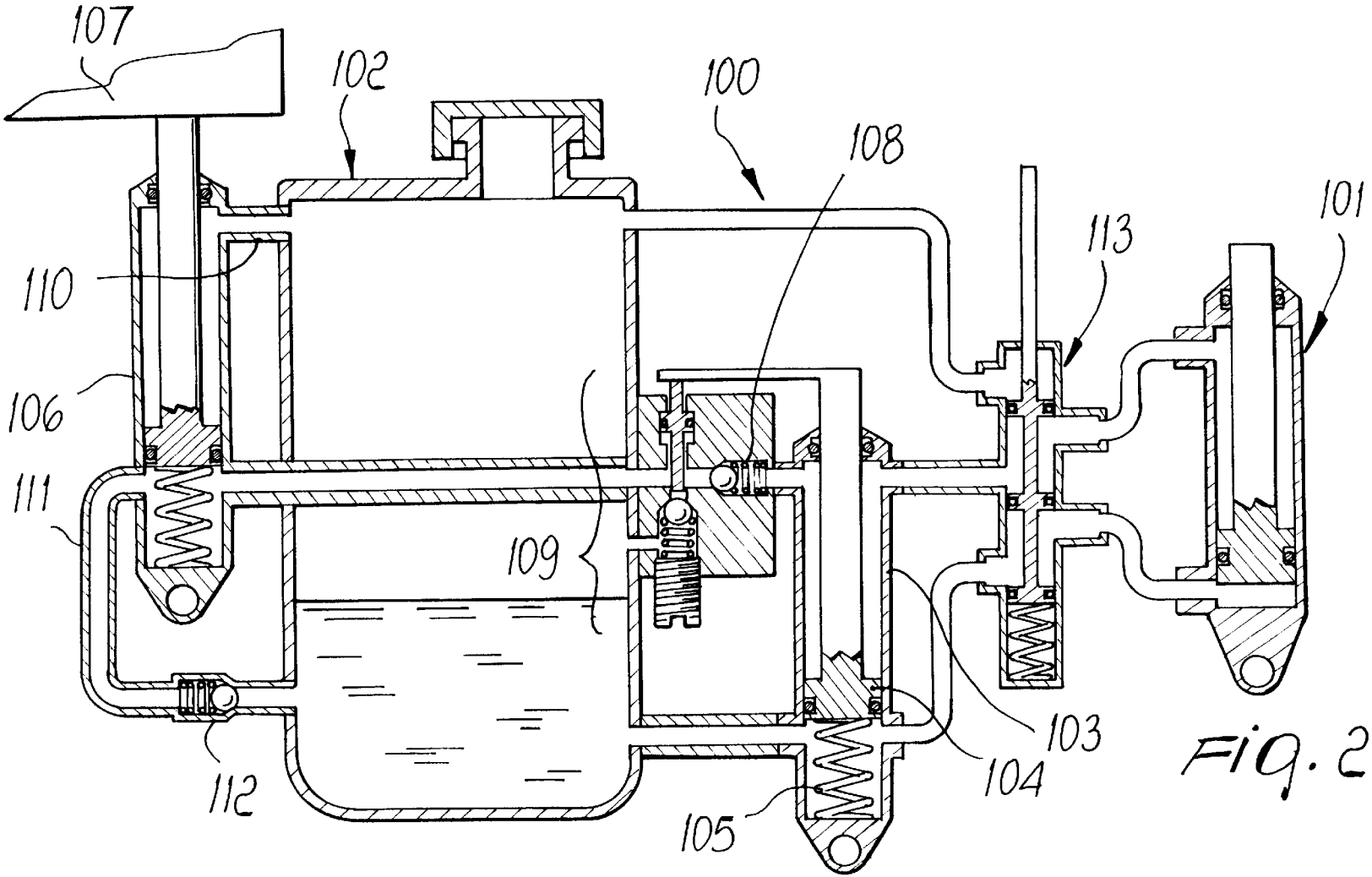
FIG. 2 is another schematic view of an actuation and supply unit according to the invention in a second embodiment.

With particular reference to FIG. 2, an actuation and supply unit according to a second embodiment of the invention is generally designated by the reference numeral 100.

In particular, the unit 100 in this case actuates and supplies an auxiliary actuator 101 constituted by a double-action hydraulic cylinder.

The unit 100 comprises a hydraulic power source, described in greater detail hereinafter, which is associated with a reservoir 102 and is connected to a section for accumulating said hydraulic power which is constituted by a first cylinder 103 with a piston 104 associated with a spring 105.

The first cylinder 103 is in turn associated with the actuator 101 through the interposition of a distribution means.

In this second embodiment, the hydraulic power source is constituted by a second cylinder 106 which is in turn actuated by the press, which is partially and schematically shown in the figure and is designated by the reference numeral 107.

In particular, the first cylinder 103 is connected to the second cylinder 106 through the interposition of a check valve 108 and a pressure limiting valve 109.

The second cylinder 106 is further connected to the reservoir 102 by means of two ducts 110 and 111.

In particular, a check valve 112 is inserted in the duct 111.

In this example, the distribution means comprises a slide valve 113 which is fully similar to the slide valve 20, to which reference is made for a more detailed description.

In practice, it has been observed that the present invention has achieved the intended aim and objects.

It should in fact be noted that the unit according to the invention excellently combines constructive simplicity with the need to make the complementary fixtures or tools substantially independent of the actuation of the press.

The accumulation of hydraulic power in fact allows to utilize said power during appropriate steps of the process without being necessarily tied to the active steps of the press.

The hydraulic power source and the actuator are in fact rendered mutually independent through the interposition of the accumulation section.

This is possible in the second described embodiment as well, since the press does indeed provide the hydraulic power but no longer forces the step or the useful period for utilizing said power.

It should also be noted that the unit according to the invention, in all of its embodiments, by making the active movement of the press substantially independent of the active movement of the auxiliary fixtures, allows said press to provide balanced dies which are not affected by other forces involved apart from those directly linked to the plastic deformation action.

Moreover, there is no restriction to the placement of the actuators in the die.

Moreover, in the case of the hydraulic power source constituted by an electromechanical motor there is no absorption of power from the press, whose power level can be reduced to the point of allowing to use it as a micropress.

If the hydraulic power source is mechanical and coupled to the press, it is possible to absorb a low amount of power from the press; this absorption can be achieved during the return step, i.e., when it does not affect the machining process.

It should also be noted that the constructive simplicity of the invention allows to manufacture it at competitive costs; moreover, by virtue of its structure it can be easily associated with different presses which may have already been manufactured.

The unit according to the invention is susceptible of numerous modifications and variations, all of which are within the scope of the inventive concept; likewise, the constructive details may be replaced with other technically equivalent elements.

Thus, for example, the reservoir 14 or 102 can be pressurized, for example by means of compressed air or other gas, which is placed directly inside the reservoir or acts on a movable or elastic wall which separates it from the fluid.

The materials employed and the dimensions may be any according to requirements.

The disclosures in Italian Patent Application No. PD97A000194 from which this application claims priority are incorporated herein by reference.

What is claimed is:

1. An actuation and supply unit, particularly for auxiliary actuators adapted to actuate complementary fixtures or tools in die-forming presses actuated by a main actuator, said supply unit comprising:

a hydraulic power source associated with a fluid reservoir; a power accumulation section connected with said power source for accumulating hydraulic power; at least one auxiliary actuator associated with said accumulation section; and valve means for controlling fluid flow between the power source and the accumulation section and said at least one auxiliary actuator, further comprising: fluid distribution means constituted by a selectively actuatable pressure fluid distributor interposed between said accumulation section and said at least one auxiliary actuator; pressure limiting means for limiting fluid pressure provided by said hydraulic power source during hydraulic power accumulation; and mechanical actuation means for actuating said pressure limiting means, said accumulation section being interposed between said power source and said fluid distribution means and in direct driving engagement with said mechanical actuation means so as to continuously control operation of said pressure limiting means and of said valve means so as to render independent, at any time during operation, said fluid distributor and said at least one auxiliary actuator from said power source.

2. The unit according to claim 1, wherein said hydraulic power accumulation section is constituted by at least one first cylinder with a piston associated with a resilient means.

3. The unit according to claim 1, wherein said hydraulic power source comprises a pump which is associated with a motor.

4. The unit according to claim 3, wherein said pump is a positive-displacement gear pump.

5. The unit according to claim 1, wherein said hydraulic power source comprises one or more second cylinders which are actuated by a press and are connected to said reservoir.

6. The unit according to claim 2, wherein said at least one first cylinder and said hydraulic power source are connected through the interposition of said valve means comprising at least one check valve.

7. The unit according to claim 1, wherein said mechanical actuation means are constituted by a flap connected to the piston of said power accumulation section for actuating through a rod a pressure limiting valve, said rod and said pressure limiting valve constituting said pressure limiting means.

8. The unit according to claim 1, wherein said distribution means is constituted by at least one externally actuated slide valve.

9. The unit according to claim 8, wherein said at least one slide valve is connected to said reservoir, to said first cylinder, and to said at least one auxiliary actuator.

10. The unit according to claim 1, wherein said at least one auxiliary actuator is of the double-action type.

11. The unit according to claim 2, wherein said resilient means of said first cylinder is constituted by a helical spring.

12. The unit according to claim 1, wherein said power accumulation section is constituted by an autoclave reservoir with an elastic membrane.

13. The unit according to claim 1, wherein said pump is connected, at its intake, to a heat exchanger.

14. The unit according to claim 1, wherein said reservoir can be pressurized by way of any of compressed air and other pressurized gas inserted directly inside the reservoir.

15. The unit according to claim 1, wherein said reservoir includes a movable elastic membrane or wall, and is pressurized by way of any of compressed air and other pressurized gas which acts on the movable or elastic wall arranged to separate the gas from the fluid.

16. The unit according to claim 2, wherein said resilient means may be any of a helical spring, a gas-tight reservoir with a movable wall and an elastic membrane which acts in contrast with said piston.

* * * * *